US005252362A

United States Patent [19]

Khan et al.

[11] Patent Number: 5,252,362

[45] Date of Patent: Oct. 12, 1993

[54] METHOD FOR PROTECTING ARTICLES FROM HYDROGEN ABSORPTION BY APPLICATION OF AN ALUMINA COATING

[76] Inventors: Abdus S. Khan, 11966 Catalpha Ave., Palm Beach Gardens, Fla. 33410; Robert J. Wright, 23 Willow Rd., Tequesta, Fla. 33469

[21] Appl. No.: 732,535

[22] Filed: Jul. 19, 1991

[51] Int. Cl.[5] ..... B05D 3/02

[52] U.S. Cl. ..... 427/318; 427/327; 427/355; 427/376.2; 427/376.4; 427/376.6; 427/427

[58] Field of Search ..... 427/318, 376.2, 427, 427/126.4, 376.4, 327, 355, 376.6

[56] References Cited

U.S. PATENT DOCUMENTS

| | | | |
|---|---|---|---|
| 2,934,456 | 4/1960 | Schutt | 427/427 |
| 3,663,280 | 5/1972 | Lee | 427/226 |
| 3,751,296 | 8/1973 | Beer | 428/209 |
| 3,885,063 | 5/1975 | Schachner et al. | 427/226 |
| 4,082,900 | 4/1978 | Shimogori et al. | 427/226 |
| 4,614,673 | 9/1986 | Bendig | 427/427 |
| 4,921,731 | 5/1990 | Clark et al. | 427/376.4 |
| 4,935,265 | 6/1990 | Pike | 427/226 |
| 4,987,003 | 1/1991 | Schuster et al. | 427/427 |

OTHER PUBLICATIONS

Nelson et al., "The Coating of Metals with Ceramic Oxides via Colloidal Intermediates", Thin Solid Films, vol. 81 pp. 329-337, 1981.

*Primary Examiner*—Terry J. Owens
*Assistant Examiner*—Benjamin L. Utech
*Attorney, Agent, or Firm*—Herbert W. Mylius

[57] ABSTRACT

A method is taught for protecting the surface of a metal subject to hydrogen embrittlement from hydrogen absorption. An adherent coating is formed on the surface of the metal substrate by heating the substrate, applying thereto a colloidal alumina suspension in a vaporizable carrier, and further heating said substrate and applied alumina suspension at an elevated temperature to form a protective alumina coating. Dopants may be employed to increase the inhibition of hydrogen diffusion through the alumina coating.

17 Claims, 4 Drawing Sheets

METHOD FOR PROTECTING ARTICLES FROM HYDROGEN ABSORPTION BY APPLICATION OF AN ALUMINA COATING

The invention was made under a U.S. Government contract and the Government has rights herein.

BACKGROUND OF THE INVENTION

1. Field of the Invention

The invention relates to a method for protecting a metal which is subject to hydrogen embrittlement, such as titanium, from hydrogen absorption, by forming an alumina coating on the surface of the article to be protected. The alumina coating, which is preferably doped to reduce the dissociation mechanism for hydrogen, provides a barrier with respect to hydrogen.

2. Description of the Prior Art

It is well known that titanium and aluminum and their respective alloys, nickel alloys, and some high strength steels, are embrittled by exposure to hydrogen atmospheres. This embrittlement may result in failure by cracking of components made from these alloys. Prior art attempts to prevent hydrogen absorption have failed to decrease this absorption to the degree necessary for present high temperature applications.

SUMMARY OF THE INVENTION

It is accordingly a primary object of the present invention to provide a method for protecting a metallic substrate from hydrogen absorption and thus hydrogen embrittlement.

In accordance with the method of the invention, a substrate subject to hydrogen embrittlement is protected from hydrogen absorption by forming an alumina coating on the surface thereof, wherein said alumina coating may contain a doping agent in such concentration as to reduce the dissociation of molecular hydrogen to hydrogen atoms.

The alumina coating may be formed by applying over the surface to be protected an alumina-containing sol, with the surface being at an elevated temperature. The surface may be heated to a temperature of up to about 300° F. prior to spraying, and maintained at this temperature during coating application. The alumina-containing sol comprises a doped colloidal alumina suspension in a vaporizable carrier, which is applied by spraying onto the surface. The vaporizable carrier may be ethyl or methyl alcohol, for example.

After spraying the suspension onto the substrate, the coated surface may be heated to a temperature of from about 1000° to about 1800° F. to cure the alumina coating. Preferably, after spraying the suspension, the coated substrate is heated at a temperature of from about 1000° to about 1200° F. for 5 to 15 minutes, and then the temperature may be increased to about 1800° F. or higher, at which temperature the coating is cured for 5 to 10 minutes.

The alumina coating may be doped with an element, such as sulfur, silicon or antimony, or an oxide or alloy thereof. This may be achieved by the addition of from 0.1 to 10.0 percent of an appropriate source of the desired dopant.

The surface may be roughened prior to forming the alumina coating thereon, which coating may have a thickness of from about 2 to 3 microns, or more.

DESCRIPTION OF THE PREFERRED EMBODIMENTS

Figure 1:
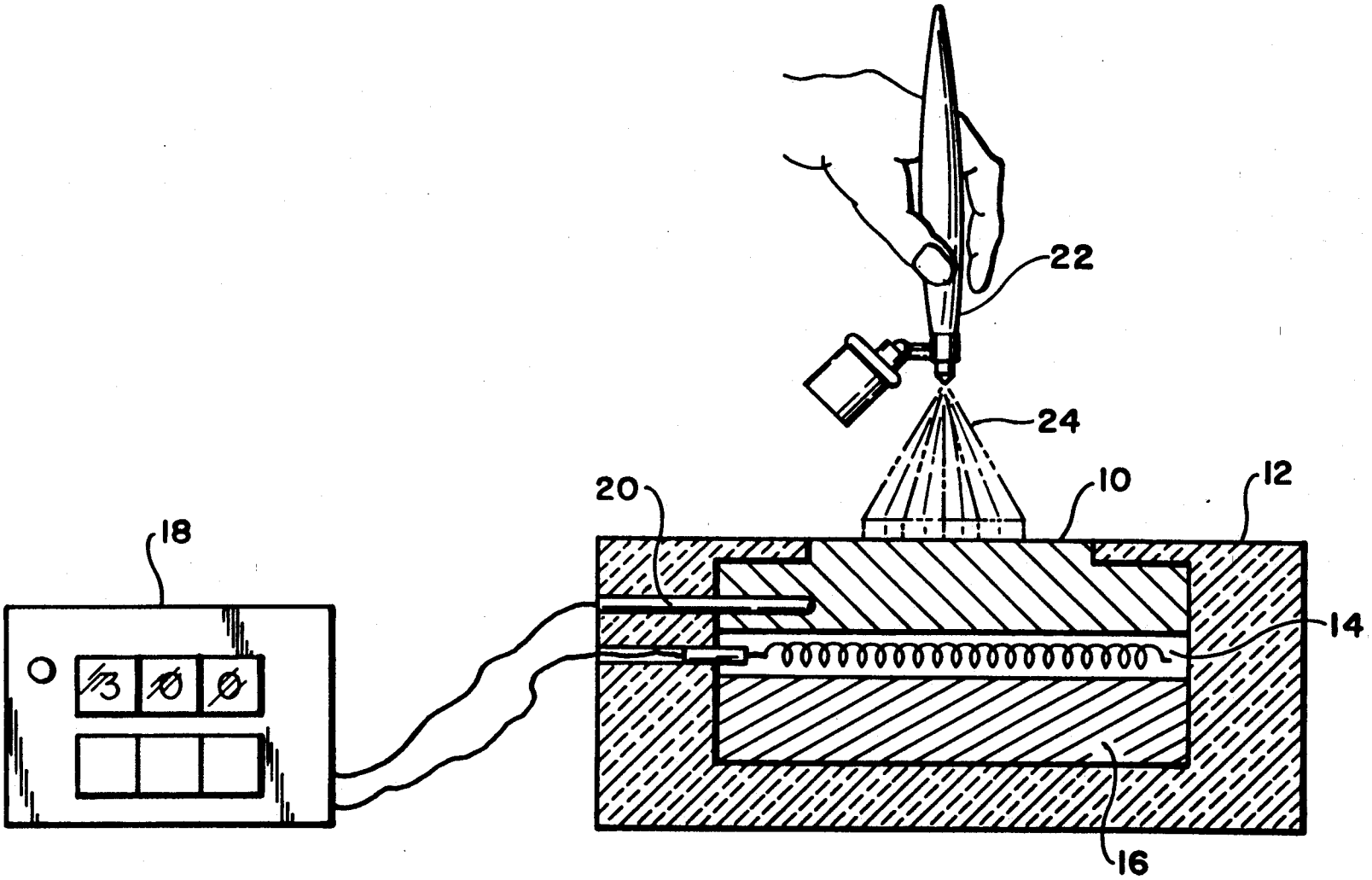
FIG. 1 is a schematic showing one embodiment of suitable apparatus for use in the practice of the invention.

An alumina sol specifically formulated for use in the present invention was prepared as follows. In a pyrex beaker with reflux, 100 cc of distilled water was stirred and heated to a temperature of 180°±5° F. An aliquot of 11 cc of 30 to 35 weight percent solution of aluminum isopropoxide in isobutanol was added directly to the heated water. The mixture was held at this temperature, with stirring, for 30 minutes. Peptizer, comprising 0.275 cc of hydrochloric acid, was then added directly into the mixture, with stirring, and the mixture stirred at temperature for an additional 40 minutes. Upon cooling to room temperature, the sol was clear and ready for use in the present invention.

While a beneficial reduction in hydrogen absorption may be obtained by the application of an undoped alumina sol to a metal surface which is subject to hydrogen embrittlement, it has been found that this improvement is amplified if dopants are present in the coating as applied. It is theorized that the dopants utilized in the present invention function in such a manner as to poison or inhibit the dissociation of hydrogen molecules at the surface of the coated substrate, thus decreasing the exposure of the substrate to atomic hydrogen, the diffusion of which is further inhibited by the alumina coating. While alpha alumina will present a more effective barrier to hydrogen diffusion than other phases of alumina, the deposition of an undoped alumina coating by the techniques utilized in the present invention results in a coating of a mixture of gamma, alpha, and other forms of pseudo-alumina phases. Based on crystal structure, the rate of hydrogen diffusion through such other forms of alumina would be expected to be higher than through alpha alumina, and such coatings would, accordingly, not be expected to form as effective a barrier to hydrogen absorption. In the preparation of barrier coatings by the deposition of alumina from a sol, the curing step is limited by the temperature capabilities of the substrate to which the coating is applied. For example, when protecting a titanium or titanium alloy substrate, the heating step is limited to temperatures of about 1800° F., well below the temperature at which the alumina coating would be converted to the alpha phase. At temperatures approaching the 2200° F. phase transition temperature, titanium will diffuse through the alumina coating, compromising the integrity thereof.

In addition to the undoped sol prepared as above, three samples of doped sols were prepared in accordance with the following procedures, to obtain examples of the above sol doped with silica, antimony trioxide, and sulfur, respectively. Such dopants as antimony trioxide and sulfur may be added in concentrations of from about 1 to about 10 percent by weight, or more, but are more preferably added in concentrations of from about 1 to about 6 weight percent, and most advantageously in concentrations of from about 3 to about 5 weight percent. Silica is preferably added in a concentration of about 25 percent by weight. Other elements which may be used as dopants include arsenic, phosphorous, bismuth, tin and germanium, and the oxides and alloys thereof, in proportions which may be readily determined experimentally. Mixtures of such elements, oxides, or alloys may also be utilized.

To a solution comprising 18 cc of distilled water and 308 cc of ethanol, was added 55.57 cc of tetraethyloxysilane. A 0.625 cc portion of this solution was then mixed with 12.5 cc of methyl alcohol, and then added to 1.875 cc of the alumina sol prepared above.

An antimony trioxide doped sol was prepared by adding 2.5 grams of antimony trioxide to the alumina sol as prepared above, after the addition of the aluminum isopropoxide. After completion of the sol formation, the sol was centrifuged to remove any large particulate.

A sulfur doped sol was prepared by bubbling hydrogen sulfide gas through an alumina sol prepared as above, until the sol turned cloudy. The sulfur doped sol was then ready for use.

While this specification is directed primarily to the protection of titanium alloy surfaces from hydrogen absorption, it is to be understood that the present invention is also applicable to other metals which are subject to hydrogen embrittlement as a result of hydrogen absorption. Such metals include aluminum and aluminum alloys, nickel and nickel alloys, and various high strength steels, which absorb hydrogen to the extent that hydrogen embrittlement is a concern.

With reference to FIG. 1, there is shown one embodiment of an apparatus for use in spraying a colloidal alumina suspension in a vaporizable carrier onto the surface of a titanium article to form a protective alumina coating thereon in accordance with the practice of the invention. A titanium article designated as 10 is provided within an insulated container 12. A radiant electric heater 14 is also provided within the container 12 between the titanium article 10 and a copper heat sink 16. A power supply and controller 18 are connected to the heater 14 with a thermocouple 20 thereof positioned for monitoring the temperature of the titanium article so that the power supply can be controlled to achieve the desired temperature during application and curing of the alumina suspension. The surface temperature should be controlled so as to not exceed about 300° F. It has been found that temperatures approaching this level help to eliminate shrinkage and/or cracking in coatings up to 3 to 5 micron thickness, and that application to cooler substrates produces coatings which do not adhere well. The rate of deposition should be carefully coordinated with the surface temperature, so as to obtain the best result. It has been found that this is achieved when a liquid surface layer is never formed on the substrate, i.e., when the coating always appears dry during application.

A conventional air brush 22 was used to provide a spray 24 of alumina suspension in a vaporizable carrier onto the surface of a titanium article 10 in laboratory applications performed to demonstrate the invention. While this apparatus is suitable, a conventional commercial spraying apparatus would be preferred for commercial application. Both ethyl and methyl alcohol have been used as the vaporizable carrier, but other carriers may also be suitable for use, such as isopropanol or butanol, with the reservation that different alcohols may produce differing surface morphologies in the final product. Water may be present in small proportions, in the presence of the vaporizable carrier, i.e. alcohol. The carrier should be present in a ratio of about 75 weight percent to about 25 weight percent of the alumina in the sol being applied, and water may be present in an amount up to about 5 weight percent. It is noted that higher percentages of water in the sol result in less protective coatings, due to cracks and/or voids formed during the volatilization of the carrier upon deposition on the hot substrate. Appropriate selection of the vaporizable carrier to be readily volatilized at the substrate temperature at the time of deposition produces a uniform coating of the sol, which must then be heated or cured to bond to the substrate. Without this curing step, the "green" coating of alumina will easily wash or rub off the substrate.

Prior to spraying, the surface of the titanium article 10 was roughened by grit blasting. The titanium article 10 was maintained at a temperature within the range of 300°±10° F. during application of the alumina suspension. After spraying, the temperature of the titanium article was increased to within the range of 1000° to 1200° F., which resulted in vaporizing the carrier and forming an adherent alumina coating on the titanium article surface. After the initial heating within the range of 1000° to 1200° F. for sufficient time to achieve these results (typically 1 minute to 1 hour), the temperature was increased to 1800° F. and maintained for one hour. At this temperature, both gamma and alpha phase alumina formed. If the curing temperature is limited to about 1200° F., predominantly gamma phase transformation is obtained, while if the curing temperature is raised to about 2200° F. or higher, a predominantly alpha phase surface coating is obtained. The overall operation was conducted in an inert argon atmosphere to prevent oxidation of the titanium article 10.

Coatings obtained experimentally by the use of the apparatus shown and described with respect to FIG. 1 have adhesion strength exceeding 10,000 psi, and the coated titanium articles have demonstrated a reduction in hydrogen absorption as illustrated by the experimental data reported hereinafter.

Samples coated in accordance with the practice shown and described with reference to FIG. 1, and conventional uncoated samples were evaluated under the hydrogen pressures, times and temperatures set forth in FIGS. 2*a*, 2*b*, and 2*c*. The hydrogen absorption of the samples was tested by placing the samples in a vacuum chamber at room temperature and evacuating to a pressure of $10^{-6}$ Torr to purge the system. The chamber was then filled with hydrogen to the test pressure, raised to the test temperature, and held at pressure and temperature for the duration of the test time. The chamber and test samples were then cooled to room temperature, and the hydrogen purged before opening the chamber. The amount of hydrogen absorption was then measured by conventional vacuum extraction methods.

Figure 2A:
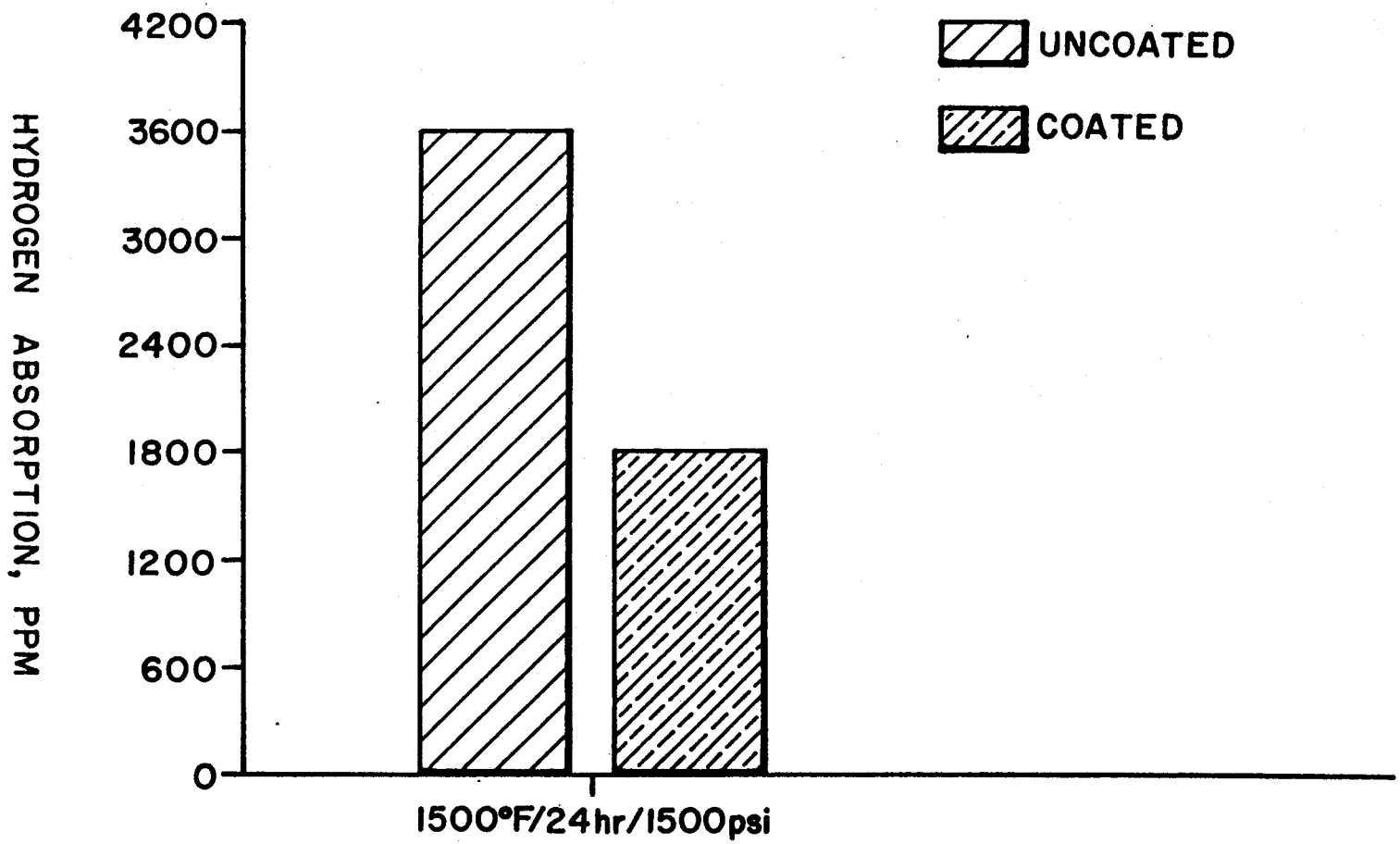
FIG. 2*a* is a bar graph showing the reduction in hydrogen absorption achieved in accordance with the practice of the invention as compared to an uncoated titanium alloy substrate, wherein the titanium alloy is characterized by high hydrogen absorption.

The graph of FIG. 2*a* shows a significant reduction in hydrogen absorption for a coated gamma phase titanium alloy sample in accordance with the invention as compared to uncoated samples. In this case, the titanium sample treated was characterized by a relatively high rate of hydrogen absorption, and the alumina coating was undoped.

Figure 2B:
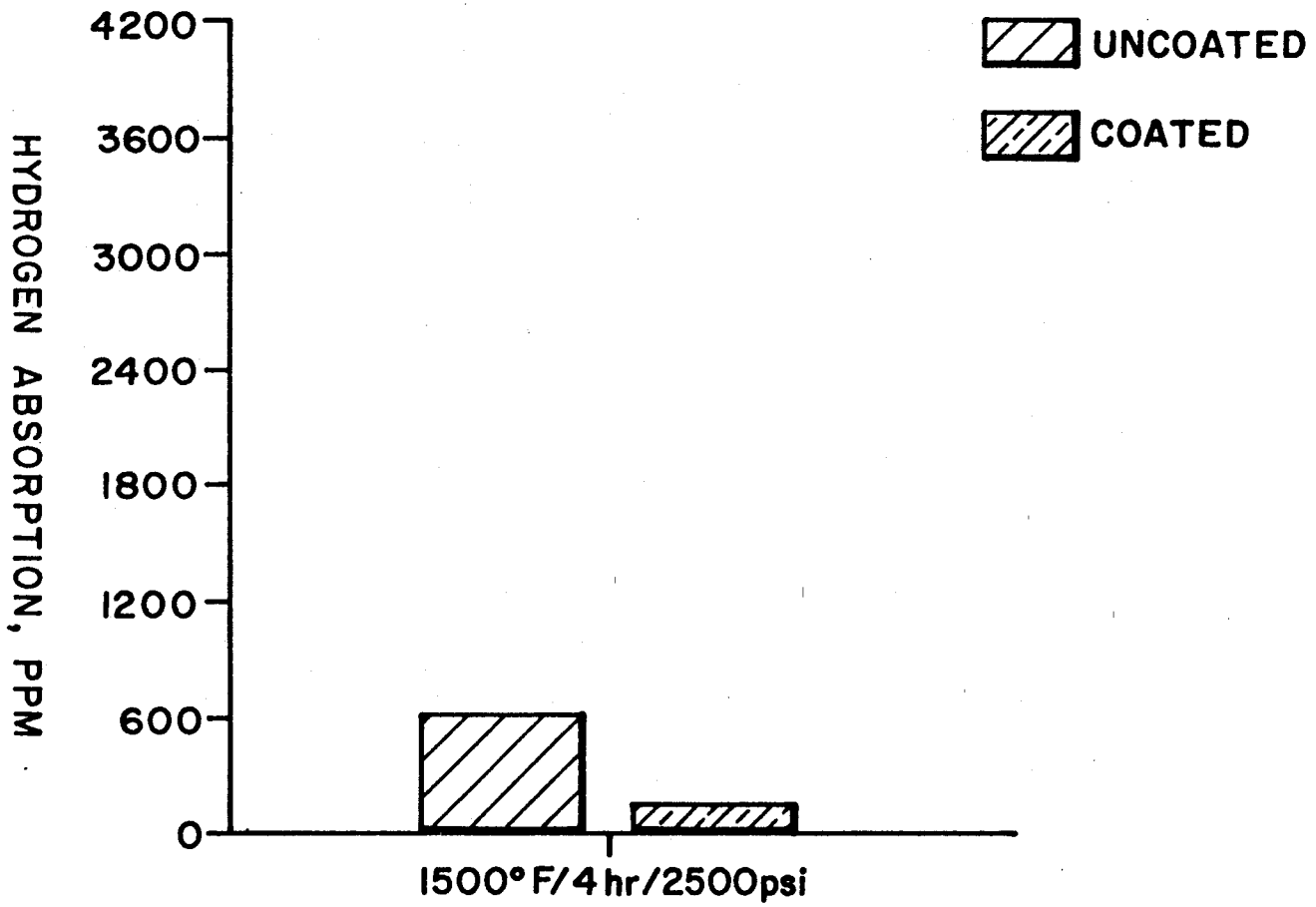
FIG. 2*b* is a bar graph showing the reduction in hydrogen absorption achieved in accordance with the practice of the invention as compared to an uncoated titanium alloy, wherein the titanium alloy is characterized by low hydrogen absorption.

FIG. 2*b* also illustrates a significant reduction in hydrogen absorption for a coated gamma titanium alloy sample, wherein the specific alloy was characterized by a relatively low rate of hydrogen absorption, and the alumina coating was undoped.

Figure 2C:
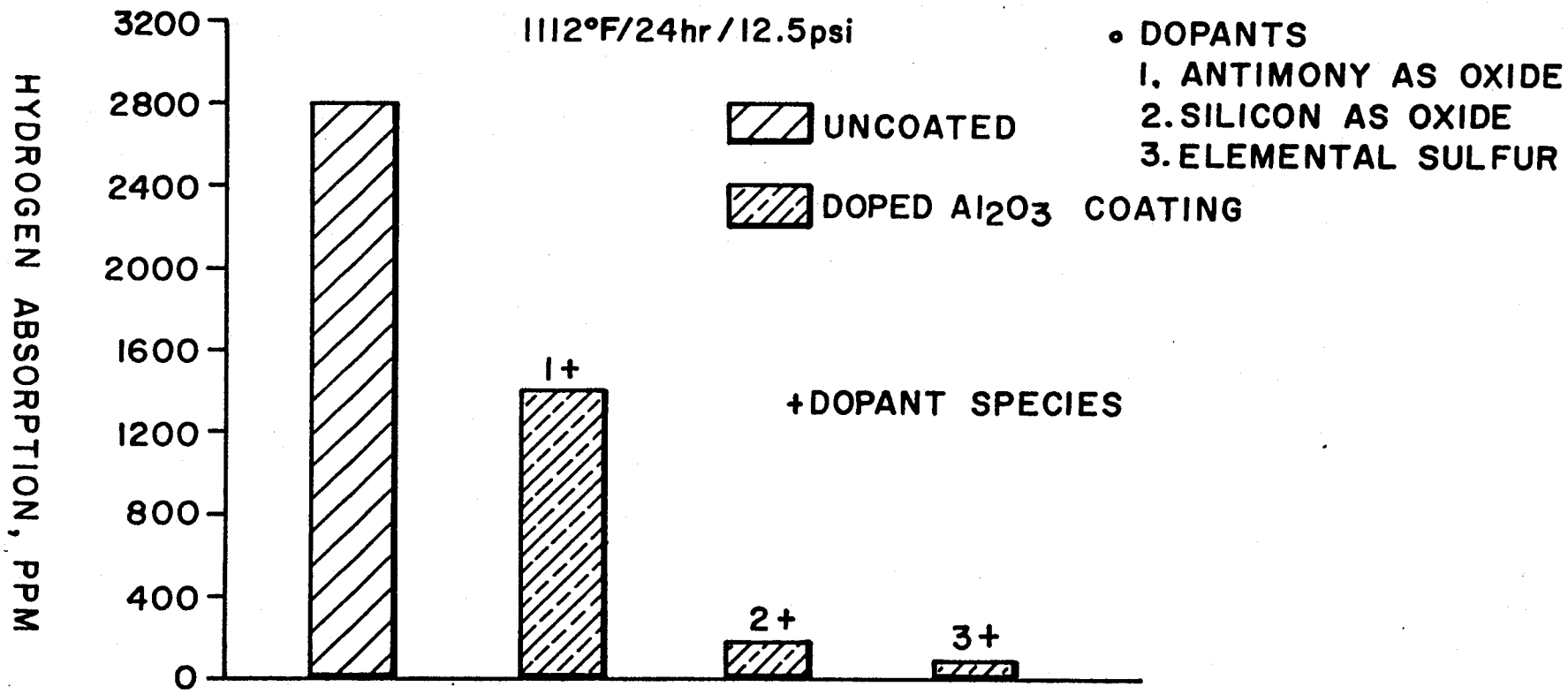
FIG. 2*c* is a bar graph demonstrating the reduction in hydrogen absorption achieved in accordance with the practice of the present invention as compared with an uncoated titanium alloy, wherein the applied alumina sol is doped with three different species of dopant.

FIG. 2*c* is a graph showing the reduction in hydrogen absorption of alpha-two titanium alloy samples coated with doped alumina in accordance with the invention, compared to conventional uncoated titanium alloy samples, with the coatings being doped with antimony as $Sb_2O_3$, silicon as $SiO_2$, and elemental sulfur.

Samples coated in accordance with the practice shown and described with regard to FIG. 1 were subjected to acoustical testing to determine coating adherence. Data resulting from these tests are presented in Table 1. The samples were of a gamma-titanium based alloy composition.

TABLE I

SUMMARY OF ACOUSTIC ENDURANCE TESTING OF HYDROGEN RESISTANT COATINGS ON GAMMA TITANIUM ALLOY SUBSTRATE

| Sample Number | Total Acoustic Exposure Time (Minutes) | Acoustic Loading | Test Sample Response Amplitude (MILS P-P) | Time at Test Condition (Minutes) | Final Visual Inspection |
|---|---|---|---|---|---|
| 89184-1 | 121 | 903Hz – 178dB + 1806Hz – 160dB | 2.2 | 10 | |
| | | 1804Hz – 159dB | 1.9 | 5 | |
| | | 903Hz – 179dB + 1806Hz – 160dB | 1.9 | 5 | |
| | | 100Hz – 700Hz White Noise + 1804Hz | 1.6 | 20 | |
| | | 903Hz – 179dB + 1806Hz – 160dB | 2.4 | 81 | No Change |
| 89184-2 | 120 | 343Hz – 186dB | 0.9 | 58 | |
| | | 910Hz – 179dB + 1820Hz – 160dB | 2.8 | 61 | No Change |

As may be seen from the above-reported tests of titanium-base alloys in accordance with the invention, the alumina coatings resulting from the method of the invention are tightly adhering and provide significantly improved protection from hydrogen absorption under elevated temperature and pressure conditions than obtained with conventional uncoated articles of the same titanium-base alloy composition. Doping of the alumina coatings with sulfur, silicon or antimony results in further improvement with respect to preventing hydrogen absorption, and may also result in modification of phase transformation temperatures. The process of the present invention may readily be automated, using conventional spray equipment and computer controllers.

All percentages disclosed herein are in percent by weight unless otherwise indicated.

It is understood that the above description of the present invention is susceptible to various modifications, changes, and adaptations by those skilled in the art, and that the same are to be considered to be within the scope of the present invention, which is set forth by the claims which follow.

What is claimed is:

1. A method for protecting a metal substrate subject to hydrogen embrittlement from hydrogen absorption, said method consisting of heating said substrate to a temperature of 300°±10° F., spraying onto the surface of said substrate a colloidal alumina suspension in a vaporizable carrier selected from the group consisting of ethyl, methyl, butyl, and isopropyl alcohols, and further heating said substrate and applied alumina suspension at a temperature of from about 1000° to about 1800° F. to form an adherent protective alumina coating thereon wherein said alumina coating is doped with a dopant selected from the group consisting of sulfur, silicon, antimony, arsenic, phosphorous, bismuth, tin, germanium, and oxides and mixtures thereof.

2. The method of claim 1 wherein said alumina coating is doped with a dopant selected from the group consisting of silica, antimony trioxide, and sulfur.

3. The method of claim 2 wherein said surface is roughened prior to forming said alumina coating thereon.

4. The method of claim 2 wherein after said spraying said suspension is heated at a temperature of about 1000° to 1200° F. for 5 to 15 minutes and then the temperature is increased to a temperature of about 1800° F. at which temperature heating is continued for 5 to 10 minutes.

5. The method of claim 4 wherein said alumina coating has a thickness of about 2 to 3 microns.

6. A method for protecting a titanium substrate from hydrogen absorption by heating said substrate to a temperature of about 300° F., applying an alumina-containing sol in a vaporizable carrier to said substrate to form a coating of alumina on said substrate, and further heating said substrate and said coating to a temperature of from about 1000° to about 1800° F. to cure said alumina sol to an adherent coating comprising both alpha and gamma phases of alumina.

7. The method of claim 6 wherein said vaporizable carrier is an alcohol.

8. The method of claim 7 wherein said alcohol is selected from the group consisting of ethyl, methyl, butyl, and isopropyl alcohols.

9. A method for protecting a titanium substrate from hydrogen absorption by forming an adherent alumina coating on the surface of said substrate, wherein said alumina coating is formed by heating said substrate to a temperature of about 300° F., applying a coating comprising an alumina-containing sol in a vaporizable carrier to said substrate, wherein said alumina-containing sol is doped with an dopant selected from the group consisting of sulfur, silicon, antimony, arsenic, phosphorous, bismuth, tin, germanium, and oxides and mixtures thereof, and further heating said substrate and said coating to a temperature of from about 1000° to about 1800° F. to cure said alumina sol to an adherent alumina coating containing said dopant.

10. The method of claim 9 wherein said alumina coating is doped with a dopant selected from the group consisting of silica, antimony trioxide, and sulfur.

11. The method of claim 9 wherein said surface is roughened prior to forming said alumina coating thereon.

12. The method of claim 9 wherein after said spraying said suspension is heated at a temperature of about 1000° to 1200° F. for 5 to 15 minutes and then the temperature is increased to a temperature of about 1800° F. at which temperature heating is continued for 5 to 10 minutes.

13. The method of claim 12 wherein said alumina coating has a thickness of about 2 to 3 microns.

14. The method of claim 9 wherein said dopant comprises from about 1 to about 25 percent by weight of said coating.

15. The method of claim 14 wherein said coating comprises from about 3 to about 5 percent antimony trioxide by weight.

16. The method of claim 14 wherein said coating comprises from about 3 to about 5 percent silica by weight.

17. The method of claim 14 wherein said coating comprises about 25 percent elemental sulfur by weight.

* * * * *